US005142329A

United States Patent [19]

Nakaya

[11] Patent Number: 5,142,329

[45] Date of Patent: Aug. 25, 1992

[54] METHOD AND APPARATUS FOR POSITIONING A CORONA DISCHARGER

[75] Inventor: Masahide Nakaya, Chigasaki, Japan

[73] Assignee: Ricoh Company, Ltd., Tokyo, Japan

[21] Appl. No.: 663,156

[22] Filed: Mar. 1, 1991

[30] Foreign Application Priority Data

Mar. 2, 1990 [JP] Japan ..... 2-50948

[51] Int. Cl.[5] ..... G03G 15/02

[52] U.S. Cl. ..... 355/221; 250/324; 355/208

[58] Field of Search ..... 355/221, 222, 223, 208, 355/209; 250/324, 325, 326; 361/225, 230

[56] References Cited

U.S. PATENT DOCUMENTS 4,320,957 3/1982 Brown et al. ..... 250/324 X

FOREIGN PATENT DOCUMENTS 57-86842 5/1982 Japan ..... 355/221

59-155862 9/1984 Japan ..... 355/221

OTHER PUBLICATIONS

Fry et al., "Corona Assembly and Alignment", May 1981, vol. 23, No. 12, p. 5619, IBM Tech. Disclosure.

*Primary Examiner*—A. T. Grimley
*Assistant Examiner*—Shuk Y. Lee
*Attorney, Agent, or Firm*—Oblon, Spivak, McClelland, Maier & Neustadt

[57] ABSTRACT

A method and apparatus applicable to electrophotographic image forming equipment or similar equipment for positioning a corona discharger relative to a photoconductive element. Two charge currents caused to flow through axially opposite end portions of the photoconductive element by a corona discharger are detected, and their difference is determined. The inclination of a discharge electrode included in the corona discharger relative to the photoconductive element is so adjusted as to reduce the difference to zero.

4 Claims, 22 Drawing Sheets

$$\text{DUTY} = \frac{T2}{T1} \times 100\ (\%)$$

Fig. 17

| No. | DETECTION SIGNAL | TRANS |
|---|---|---|
| 1 | PTIac | PT TRANS 26 |
| 2 | PTIdc | |
| 3 | DIac | D TRANS 27 |
| 4 | DIdc | |
| 5 | PCIac | PC TRANS 28 |
| 6 | PCIdc | |

Fig. 18

| No. | DETECTION SIGNAL | TRANS |
|---|---|---|
| 1 | PTVac | PT TRANS 26 |
| 2 | PTVdc | |
| 3 | DVac | D TRANS 27 |
| 4 | DVdc | |
| 5 | PCVac | PC TRANS 28 |
| 6 | PCVdc | |

METHOD AND APPARATUS FOR POSITIONING A CORONA DISCHARGER

BACKGROUND OF THE INVENTION

The present invention relates to a corona discharger incorporated in electrophotographic image forming equipment and, more particularly, to a method and apparatus for positioning the corona discharger relative to a photoconductive element also incorporated in the equipment easily and rapidly.

A laser printer, facsimile transceiver or similar electrophotographic image forming equipment has a photoconductive element in the form of a drum or a belt, and several corona dischargers such as a main charger, transfer charger and separation charger arranged around the photoconductive element. The dischargers each effects a corona discharge between it and the photoconductive element to cause a discharge current to flow through the element for the purpose of depositing or dissipating a charge on the element. Generally, the amount of charge, for example, deposited on the photoconductive element has critical influence on the quality of an image to be formed on the element. Hence, the amount of charge, among others, has to be controlled with accuracy in order to form desirable images. The problem with a corona charger for the above application is that the particles of toner, paper dust and dust existing in air sequentially collect on and thereby contaminate the discharger, particularly a discharge electrode or wire thereof. Since this kind of contamination adversely affects the discharge, it is necessary to remove the corona discharger for cleaning or replacement periodically. However, when the cleaned or a new corona discharger is so set as to face the photoconductive element, it is likely that the positional relation between the discharger to the photoconductive element, i.e., the distance between the discharge electrode or wire and the surface of the photoconductive element changes. It follows that the distance between the wire of the corona discharger and the surface of the photoconductive element has to be adjusted accurately to insure an image having uniform density. For this kind of adjustment, it is a common practice to remove the photoconductive drum, for example, from the equipment and the set a false photoconductive drum, or jig drum, in place of the removed photoconductive drum. In this condition, while a charge current which flows through the surface of the jig drum is measured at axially opposite ends of the drum alternately, an adjusting screw provided on the front of the corona discharger is turned until the currents flowing through the opposite ends of the jig drum become equal to each other. After such adjustment, the cleaned or a new photoconductive drum is substituted for the jig drum.

The above-stated conventional procedure for adjusting the positional relation between the photoconductive drum and the corona discharger, i.e., the distance between the surface of the photoconductive element and the discharge electrode or wire of the discharger is extremely time- and labor-consuming and, moreover, inhibits the equipment from being operated until the adjustment completes.

SUMMARY OF THE INVENTION

It is therefore an object of the present invention to provide a method and apparatus which allows a corona discharger to be positioned relative to a photoconductive element easily and rapidly.

It is another object of the present invention to provide a generally improved method and apparatus for positioning a corona discharger.

In accordance with the present invention, an apparatus for positioning, relative to a photoconductive element of an image forming apparatus, a corona discharger located to face and extend along the axis of the photoconductive element and provided with a discharge electrode which causes a discharge to occur between it and the photoconductive element in response to a high voltage fed from a power source and thereby causes a charge current to flow through the photoconductive element comprises a current detecting circuit for detecting the charge current flowing through the photoconductive element, and a position data generating circuit for generating position data associated with the corona discharger relative to the photoconductive element in response to the charge current detected by the current detecting circuit.

Further, in accordance with the present invention, a method of positioning, relative to a photoconductive element of an image forming apparatus, a corona discharger located to face and extend along the axis of the photoconductive element and provided with a discharge electrode which causes a discharge to occur between it and the photoconductive element in response to a high voltage fed from a power source and thereby causes a charge current to flow through the photoconductive element comprises the steps of causing the corona discharger to effect a discharge between it and the photoconductive element so as to cause a charge current to flow through the photoconductive element, detecting the values of two currents each flowing through respective one of axially opposite end portions of the photoconductive element, determining a difference between the values of the two currents, and effecting adjustments such that the difference decreases to zero.

BRIEF DESCRIPTION OF THE DRAWINGS

The above and other objects, features and advantages of the present invention will become more apparent from the following detailed description taken with the accompanying drawings in which:

FIGS. 17 and 18 are maps indicative of the correspondence of various signals.

DESCRIPTION OF THE PREFERRED EMBODIMENT

Figure 1:
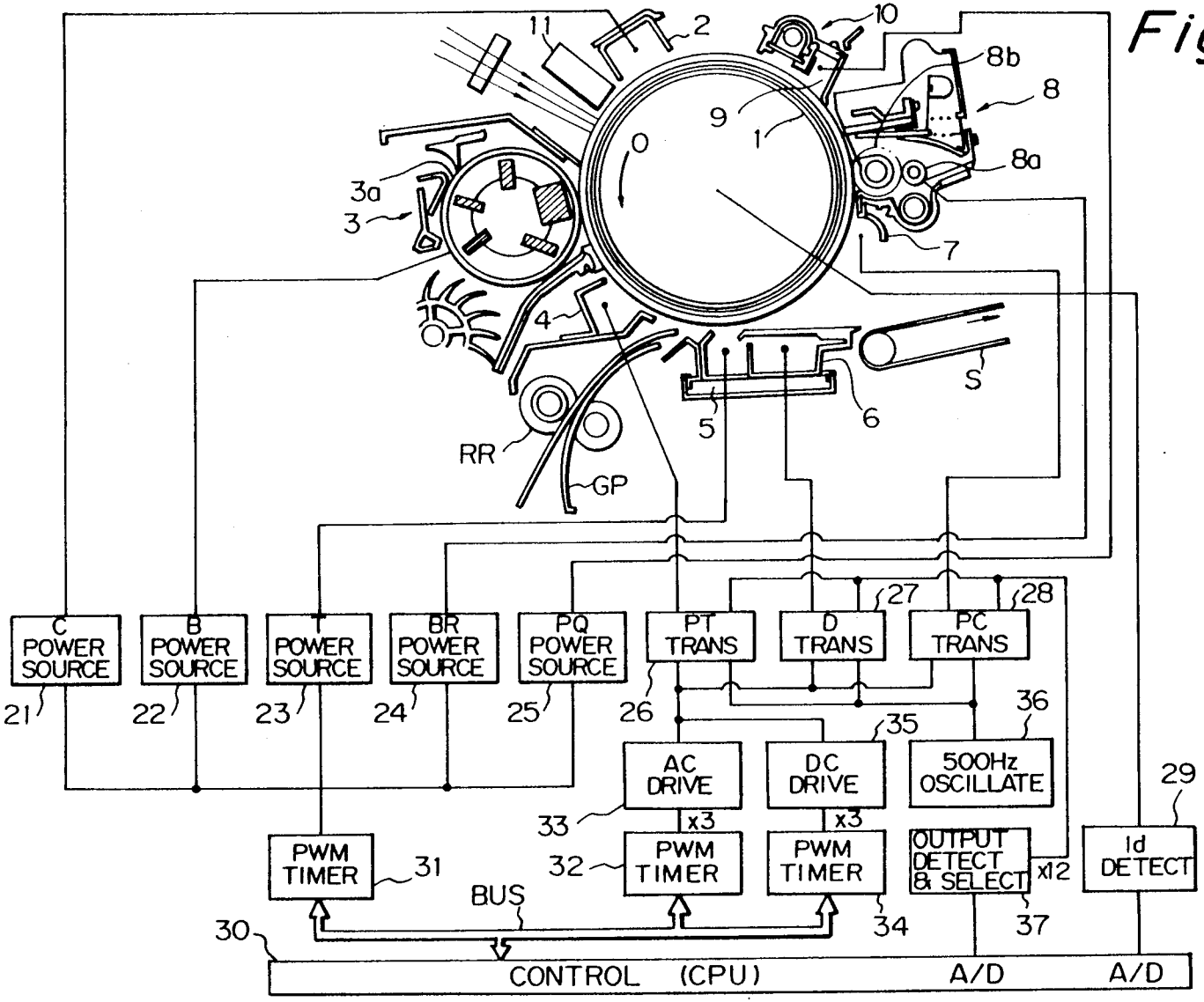
FIG. 1 is a block diagram schematically showing an image forming section and a high voltage generating section included in a copier having corona dischargers to which the present invention is applied.

Referring to FIG. 1 of the drawings, an electrophotographic copier belonging to a family of image forming equipment of the type having a corona discharger and to which the present invention is applied is shown. Particularly, the figure shows an image forming section and a high voltage generating section of such a copier. As shown, the image forming section has a photoconductive element in the form of a drum 1 which is rotatable as indicated by an arrow O. The drum 1 is connected to ground via a charge current detecting circuit (hereinafter referred to as an Id detecting circuit) 29. Arranged around the drum 1 are a corona charger or C corona charger 2 connected to a main charge high-tension power source or C power source 21, a developing unit 3 having a sleeve 3*a* which is connected to a developing bias power source or B power source 22, a corona discharger or PT corona discharger 4 connected to a pretransfer high-tension power source or PT transformer 26, a corona discharger or T corona discharger 5 connected to a transfer high-tension power source or T power source 24, a corona discharger or D corona discharger 6 connected to a separation high-tension power source or D transformer 27, a corona discharger or PC corona discharger 7 connected to a precleaning high-tension power source or PC transformer 28, a cleaning unit 8 having a bias roller 8*a* connected to a cleaning bias power source or BR power source 24, a corona discharger or PQ corona discharger 9 connected to a discharging high-tension power source or PQ transformer 25, a discharge lamp 10, and an eraser 11. A guide plate GP and a feed roller RR are provided on a paper inlet path between the PT corona discharger 4 and the T corona discharger 5. A paper transporting device S is disposed downstream of the D corona discharger 6 for transporting a paper sheet carrying an image thereon to a fixing unit, not shown.

The high voltage generating section has a control circuit (CPU) 30 to which PWM (pulse Width Modulation) timers 31, 32 and 34 are connected by a bus line BUS. The PWM time 31 is connected to the power sources 21, 22, 23, 24 and 25 each of which generates a DC high voltage. The PWM timer 32 is connected to an AC drive circuit 33 while the PWM timer 34 is connected to a DC drive circuit 35. The AC and DC outputs of the AC drive circuit 33 and DC drive circuit 35, respectively, are superposed and applied to the PT transformer 26, D transformer 27, and PC transformer 28. A 500 Hz oscillation circuit 36 and an output detecting and selecting circuit 37 are also connected to the transformers 26, 27 and 28. The CPU is connected by a serial data communication circuit, not shown, to a main controller, not shown, which controls the operations of the entire copier.

The image forming process of the copier shown in FIG. 1 will be outlined hereinafter.

The drum 1 whose major component is selenium or similar material is charged to a high potential of, for example, positive polarity (about 800 V) by the corona discharge of the C corona discharger 2. The charged surface of the drum 1 is exposed to image light to form a particular potential distribution, i.e., an electrostatic latent image representative of a document image. In the developing unit 3, a toner is transferred from the developing sleeve 3*a* to the drum 1 on the basis of the potential distribution or latent image, thereby forming a toner image on the drum 1. Subsequently, the PT corona discharger 4 effects AC corona discharge to reduce the electrostatic attraction acting between the toner and the drum 1. On the other hand, a paper sheet is fed by the feed roller RR in synchronism with the formation of the image on the drum 1 and thereby brought into register with the toner image. The T corona discharger 5 applies an electric field opposite in polarity to the charge of the toner (negative in this case) to the back of the paper sheet, whereby the toner image is transferred from the drum 1 to the paper sheet. Then, the D corona discharger 6 applies an AC voltage to the back of the paper sheet with the result that the paper sheet is separated from the drum 1 by gravity. The paper sheet so separated from the drum 1 is driven toward the transporting device S. After such image transfer, the PC corona discharger 7 applies an AC electric field to the drum 1 to uniformize the potential, and then a fur brush 8*b* included in the cleaning unit 8 removes toner particles and paper dust remaining on the drum 1. The toner collected by the fur brush 8*b* is removed from the brush 8*b* by the bias roller 8*a* and then driven into a toner storage, not shown. Thereafter, the PC corona discharger 9 dissipates the charge remaining on the drum 1 by a DC electric field, and the discharge lamp 10 further discharges the drum 1 by light. As a result, the drum 1 is restored to the initial state thereof.

Figure 2:
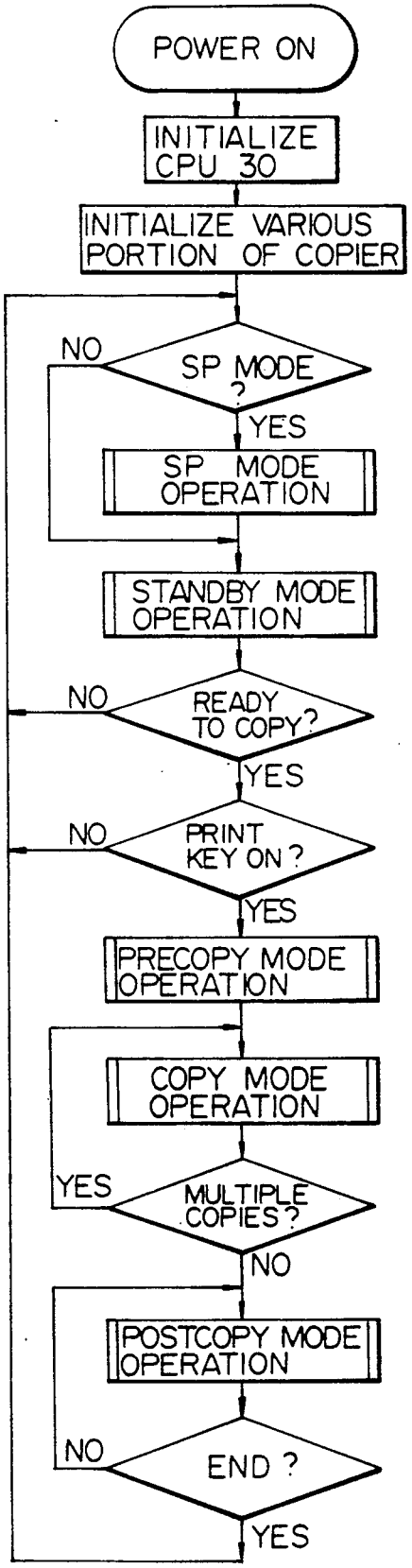
FIG. 2 is a flowchart demonstrating a specific copying operation of the copier.

FIG. 2 shows a specific copying operation performed by the copier. As shown, on the turn-on of a power switch provided on the copier, the CPU 30 and then the various sections of the copier are initialized. The initialization includes a steps of setting the discharge current, or drum charge current, of each corona discharger existing in the image forming section. The initialization is followed by a standby mode operation which includes display processing associated with the operation board of the copier, reading various key inputs and processing matching the key inputs, reading the outputs of various sensors, and error checking. It is to be noted that the standby mode is preceded by a step of determining whether or not an SP mode for service maintenance has been selected and, if it has been selected, SP mode processing is executed.

The standby mode operation stated above is repeated until the operator presses a print key also provided on the copier. On the turn-on of the print key, a precopy mode operation is performed for feeding a paper sheet to the image forming section. Then, a copy mode operation is effected. Specifically, the on/off control over the corona dischargers, the control over the sections joining in the copying process and the transport of the paper sheet are executed at given timings which match the document size and paper size. When a plurality of reproductions are desired, the copy mode operation is repeated. The copy mode operation is followed by a postcopy mode operation for discharging the paper sheet, setting the discharge currents of the corona dischargers, etc. Thereafter, the program returns to the previously stated standby mode. The discharge currents are set (drum charge current set mode which will be described) during the postcopy mode operation, i.e., while the operator is removing the copies and documents. During the drum charge current set mode, the induced currents from the developing unit 3 and cleaning unit 8 which contact the drum 1 are maintained constant by maintaining the bias voltages applied to the developing sleeve 3*a* and bias roller 8*a* constant.

Figure 3:
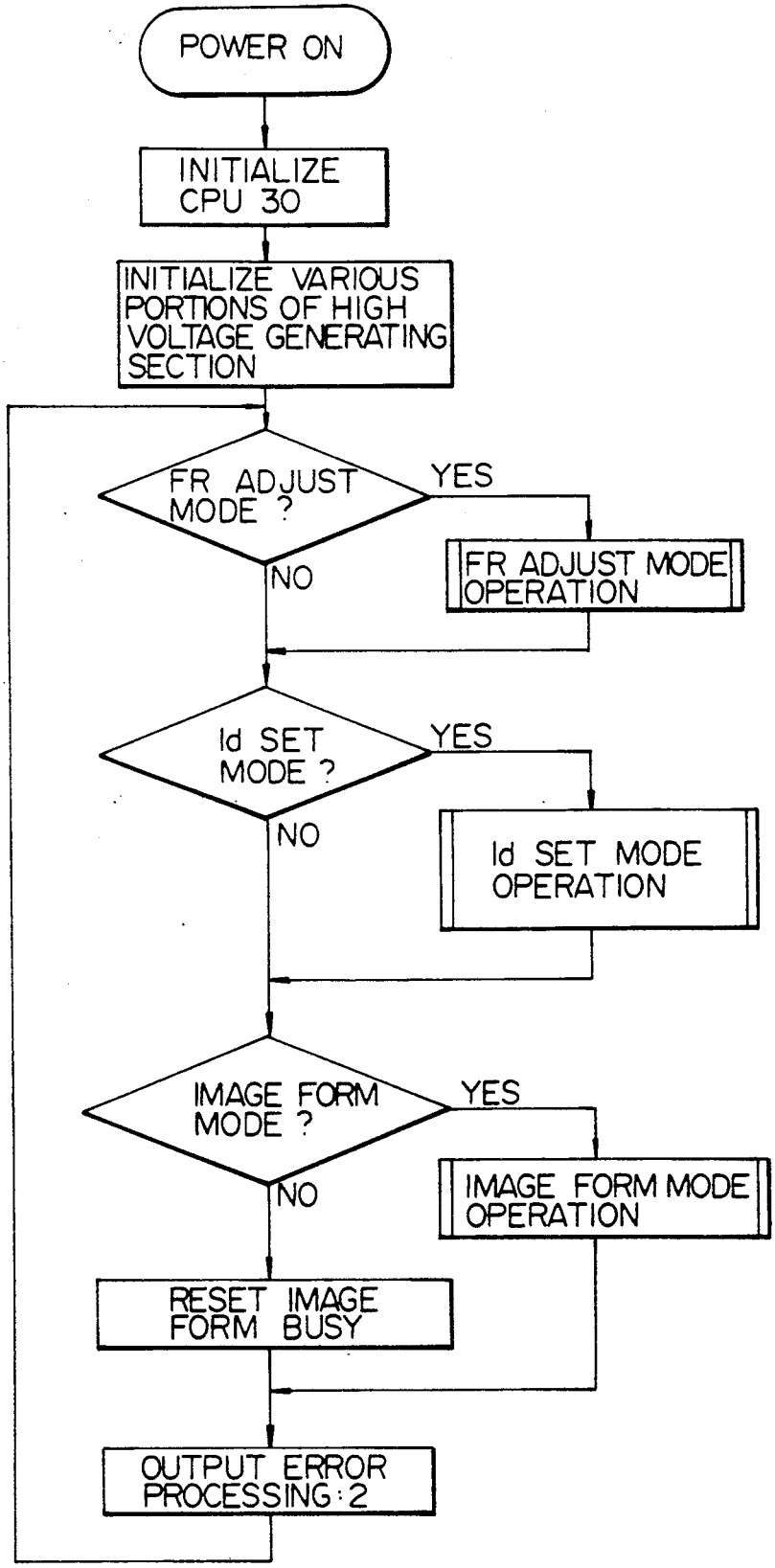
FIG. 3 is a flowchart representative of a specific operation of the high voltage generating section.

A specific program associated with the high voltage generating section is shown in FIG. 3. As shown, on the turn-on of the power switch, the CPU 30 and then various portions of the high voltage generating section are initialized. Specifically, immediately preceding values such as the content of the PWM timer 31 and the target values for constant current control and drum charge current set mode are read out of a back-up memory of the main controller and set in the CPU 30. Further, a signal to be fed to the CPU 30 is selected by the output detecting and selecting circuit 37, and then as FB interrupt timer loaded with processing timings is started. Therefore, when the individual power sources and transformers are triggered after the above settings, a particular high voltage is applied to each of the corona dischargers. This is followed by a repetitive loop of an FR adjust mode which adjusts the positions of opposite ends of the wire, or discharge electrode, of each corona discharger, a drum charge current set mode or Id set mode, an image form mode, and output error processing: 2. These modes each is executed in response to an interrupt signal fed from the main controller, as needed. Usually, after the Id set mode has been executed on the turn-on of the power switch, the image form mode is effected on the turn-on of the print key and in association with the copy mode processing of the main controller. Then, in the postcopy mode, the Id set mode is executed. Hence, once the power switch is turned on, the Id set mode occurs every time the print key is pressed.

Figure 4A:
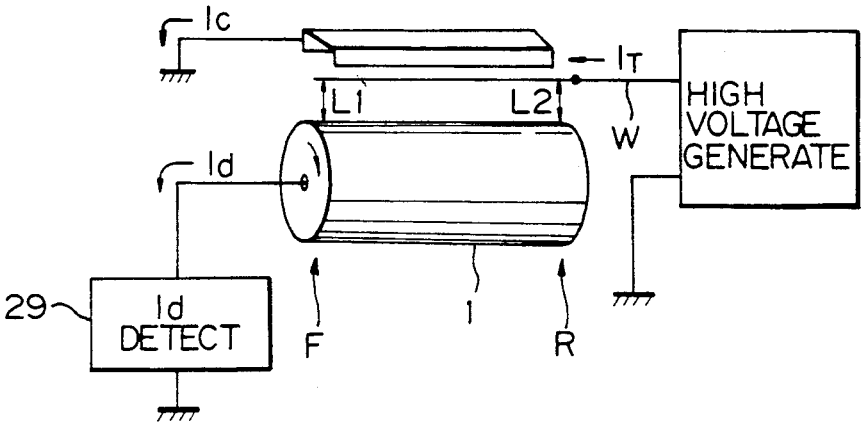
FIGS. 4A to 4C are block diagrams each schematically showing a particular path along which a current flows between a corona discharger and a photoconductive element.
Figure 5:
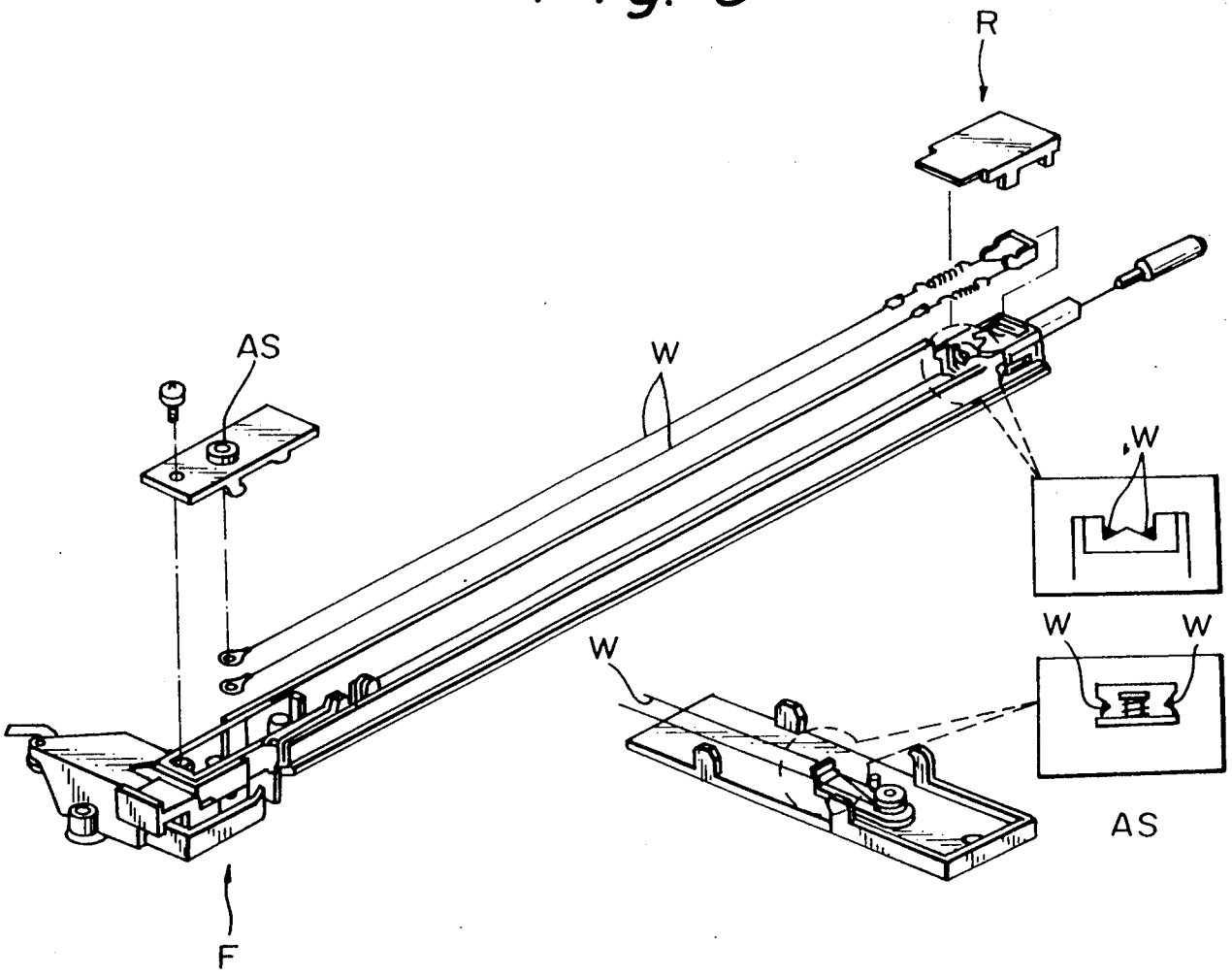
FIG. 5 is a perspective view showing a specific construction of a corona discharger.

The SP mode mentioned above includes various kinds of modes for service maintenance. The following description will concentrate on the FR adjust mode only. The FR adjust mode is effected to eliminate an irregular image density ascribable to the inclination of the discharge electrode or wire of a corona discharger relative to the drum 1. The inclination of the discharge electrode is apt to occur in the event of replacement of the corona discharger. Specifically, FIG. 4A shows a discharge electrode or wire W adjoining the surface of the drum 1. Let the left end and the right end of the discharge electrode W as viewed in FIG. 4A be respectively referred to as the front end F and the rear end R with respect to the front-and-rear direction of the copier. To correct the inclination of the electrode W relative to the drum 1, the distance L1 between the front end F of the electrode W and the drum 1 and the distance L2 between the rear end R of the electrode W and the drum 1 are adjusted. Specifically, as shown in FIG. 5, an adjusting screw AS is turned to adjust the height of the front end F of the electrode W as measured from the drum 1.

Figure 6:
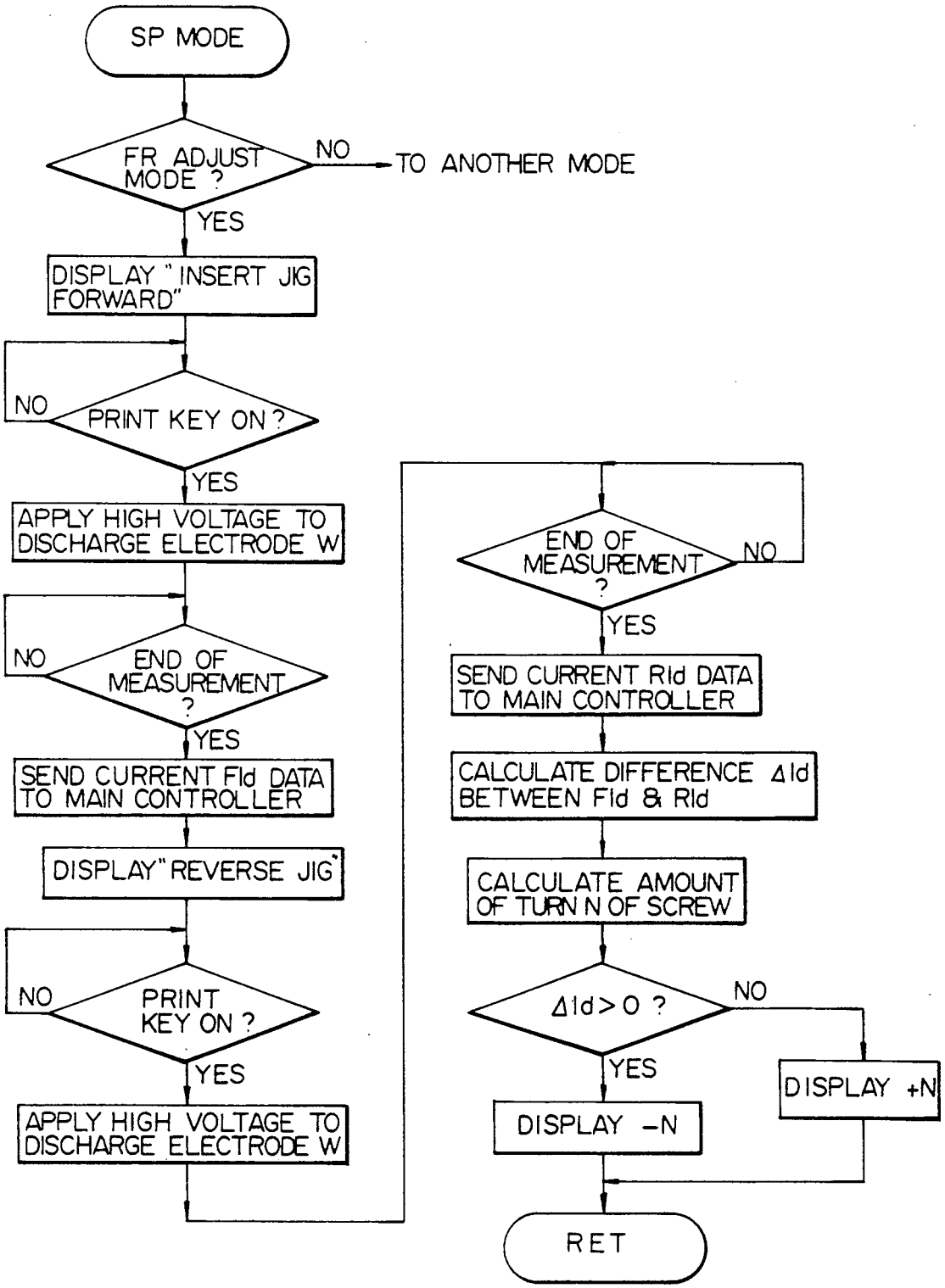
FIGS. 6 and 8 are flowcharts demonstrating an SP mode subroutine and an FR mode subroutine, respectively.
Figure 7:
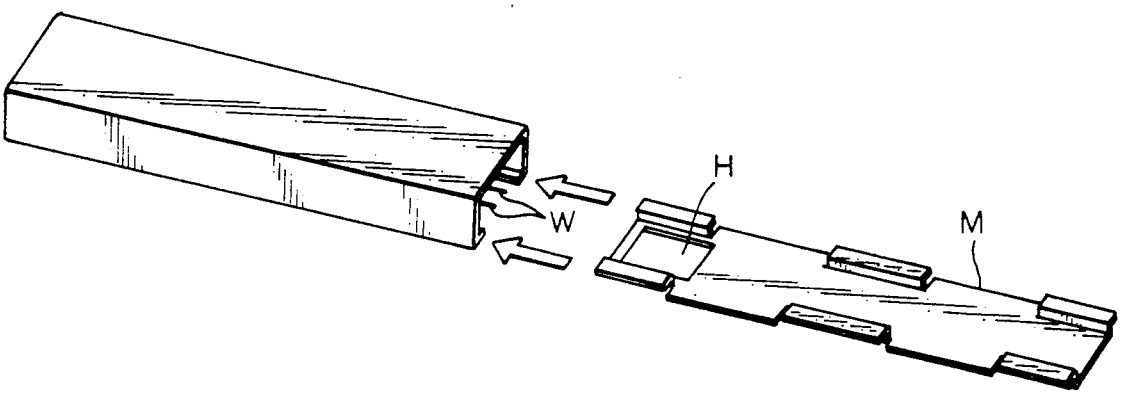
FIG. 7 is a perspective view showing a corona discharger and a masking jig to be removably fitted thereon.

FIG. 6 shows the SP mode which is rendered effective when the operator operates a dip switch, not shown, mounted on the copier body. In the SP mode, the operator may manipulate the keys provided on the operation board of the copier to enter various commands for service maintenance. When a command designating the FR adjust mode is entered, a message such as "INSERT JIG FORWARD" appears on a display also provided on the operation board. Then, the operator inserts a masking jig M (see FIG. 7) into the corona discharger in such an orientation that a hole H formed through the jig M aligns with the front end F of the discharger. The masking jig M is implemented as a molding of plastic, i.e., insulator and configured to be movable into and out of the corona discharger. When the masking jig M is loaded in the corona discharger in the above-mentioned orientation, the opening of the discharger which faces the drum 1 is masked except for the portion thereof which faces the hole H. Since the hole H is positioned at one end of the jig M, only one end of the corona discharger is open to the drum 1 due to the orientation of the jig M.

Figure 4B:
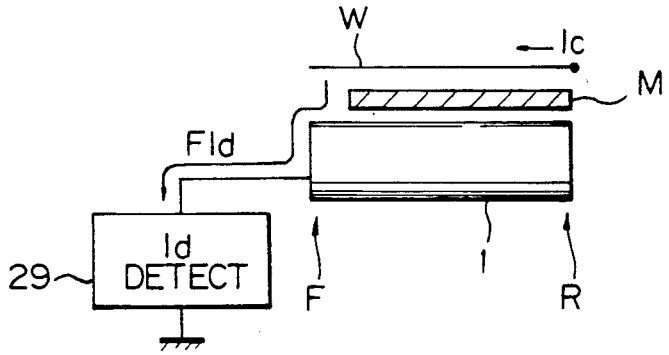
Figure 8:
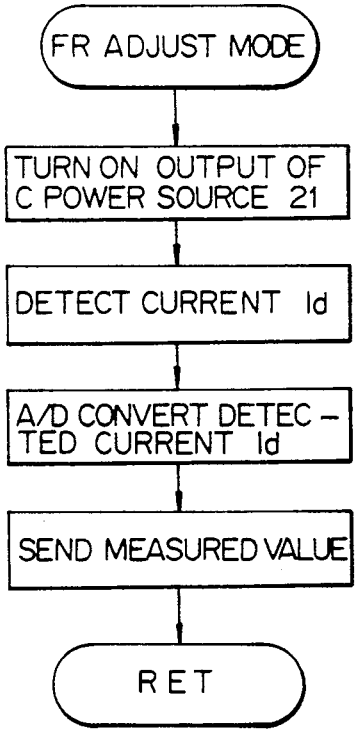

In the above condition, as the operator presses the print key on the operation board, an FR adjust mode start flag is sent to the CPU 30 by interruption. In response, the high voltage generating section with the CPU 30 executes a subroutine associated with the FR adjust mode, as shown in FIG. 8. As a result, a predetermined high voltage is applied to the electrode W of the corona discharger, and a current flows through the drum 1 due to corona discharge. The discharge occurs only at the front end F where th ehole H of the masking jig M is located, so that a current FId shown in FIG. 4B flows through the drum 1. The current FId is detected by the detecting circuit 29, converted into digital data by an analog-to-digital (A/D) converter built in the CPU 30, and then sent to the main controller.

Figure 4C:
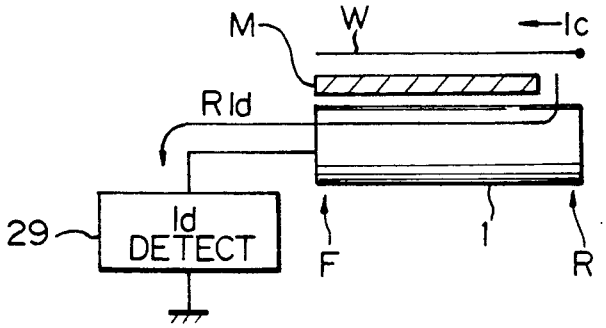

Subsequently, a message such as "REVERSE JIG" appears on the display. Then, the operator reverses the orientation of the masking jig M in the front-and-rear direction and inserts in into the corona discharger. In this case, the hole H of the jig M faces the rear end R of the corona discharger. When the operator presses the print key again, the predetermined high voltage is applied to the electrode W with the result that a current flows through the drum 1 due to corona discharge. FIG. 4C shows a current RId flowing through the drum 1 in such a condition. Again, the Id detecting circuit 29 detects the current RId and feeds it to the D/A converter of the CPU 30. The resulted digital data is transmitted to the main controller.

Thereupon, the difference ΔId between the currents FId and RId measured at the front and rear ends F and R, respectively, is produced. Then, the amount of turn N of the adjusting screw AS which reduces the difference ΔId to zero is calculated, as follows:

$$N = \Delta Id / Ids$$

where Ids is a change in the current ID per turn of the screw AS.

The required amount of turn N of the screw AS determined by the above equation appears on the display together with the sign "+" or "−". As the operator turns the screw AS according to the value appearing on the display, the inclination of the electrode W relative to the drum 1 and, therefore, the difference ΔId is reduced to zero. Such adjustment does not have to be effected more than once.

In the illustrative embodiment, the current Io to be fed from the high voltage generating section to the corona discharger, i.e., the output current of the power source in the FR adjust mode is selected to be smaller than the current which will be fed during ordinary image forming operations.

Figure 9:
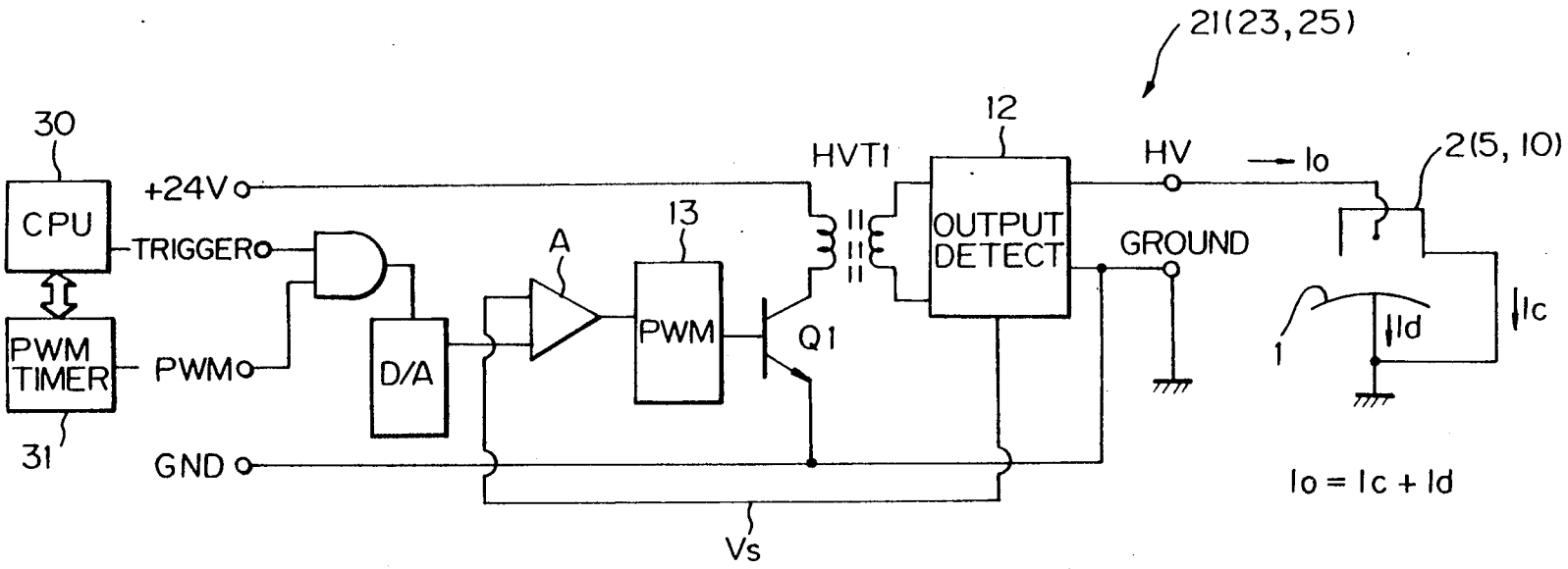
FIG. 9 is a block diagram schematically showing a specific construction of part of the high voltage generating section.
Figure 10:
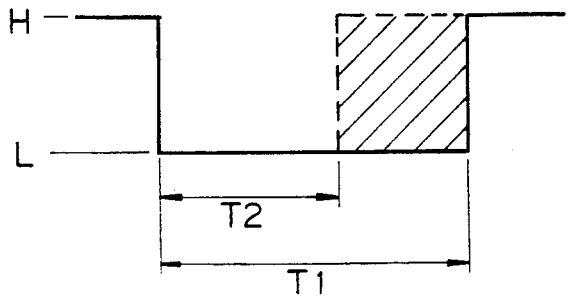
FIG. 10 plots the waveform of a pulse width modulation (PWM) signal which a PWM timer shown in FIG. 1 outputs.
Figure 11:
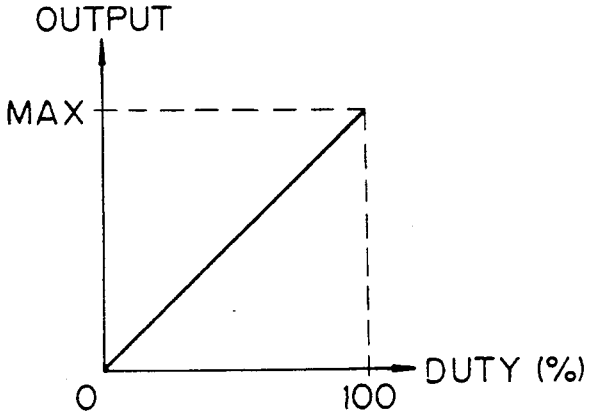
FIG. 11 is a graph indicative of a relation between the duty of the PWM signal and the output voltage.

Among the power sources incorporated in the high voltage generating section, the C power source 21, T power source and PQ power source 25 each outputs a high voltage of about 6000 V for corona discharge, and their output currents are maintained constant. Since the power sources 21, 23 and 25 have an identical circuit arrangement, one of them will be described with reference to FIG. 9. As FIG. 9 indicates, the power source itself has a function of stabilizing the output thereof. Specifically, as shown in FIG. 10, the PWM timer 31 feeds to the power source circuit a PWM signal whose pulse width T2 changes at a period of T1 (e.g. 1 kV). A DA converter is built in the power source circuit and plays the role of an integrating circuit, i.e., it integrates or smoothes the input PWM signal to generate an analog signal whose level changes with the change in the pulse width of the PWM signal. The analog signal is applied to the reference voltage terminal of a comparator A. Comparing the level on the reference voltage terminal and the level of a voltage signal Vs fed back from the output detecting circuit 12, the comparator A feeds the resultant difference or error signal to the PWM circuit 13. In response, the PWM circuit 13 produces a pulse signal whose duration corresponds to the input error signal and feeds it to a transistor Q1. As a result, the transistor Q1 is turned on or off to switch the current flowing through the primary winding of a high-tension transformer HVT1. Hence, the switching duty of the transistor Q1 corresponds to the error signal, i.e., a high voltage corresponding to the error signal flows through the secondary winding of the transformer HVT1. The high voltage is transformed into a direct current Io by a rectifying circuit and then applied to a load (corona discharger 2, 5 or 10). The output detecting circuit 12 detects the voltage Vs corresponding to the load current or discharge current and feeds it back to the associated input terminal of the comparator A. As a result, if the duty of the PWM signal fed from the PWM timer 31 to the power source circuit is constant, the load current flowing through the corona discharger 2, 5 or 10 remains constant. When the duty of the output signal of the PWM timer 31 is adjusted, the load current flowing through the discharger 2, 5 or 10 changes accordingly.

The B power source 22 and BR power source 24 each is implemented as a constant voltage power source outputting a DC voltage (about 600 V) and stabilizes the output voltage thereof. The power sources 22 and 24 are identical in construction and operation with the power source 21, 23 or 25 except for the substitution of a voltage detecting circuit for the current detecting circuit.

Figure 12:
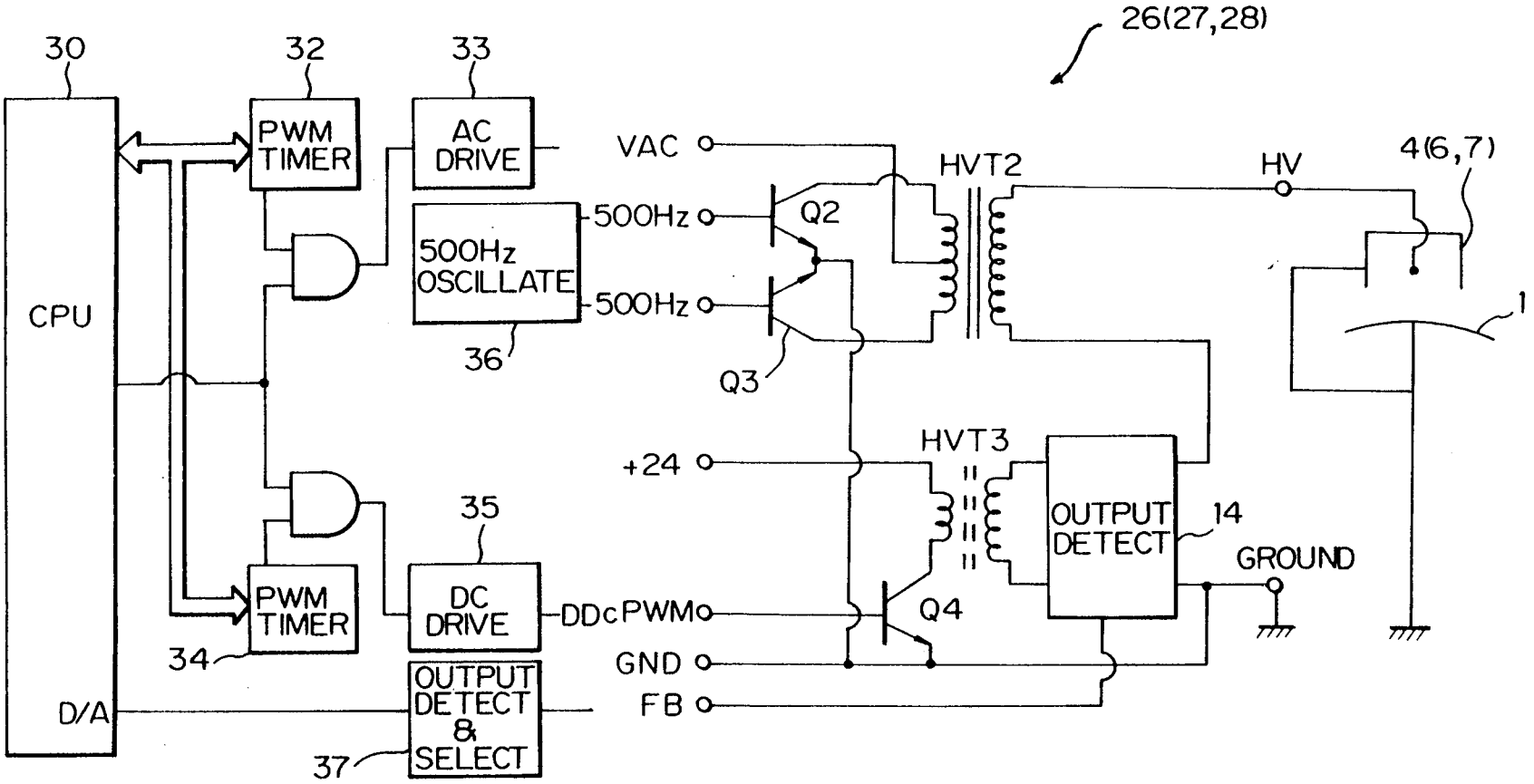
FIG. 12 is a block diagram schematically showing a specific construction of part of the high voltage generating section.
Figure 13:
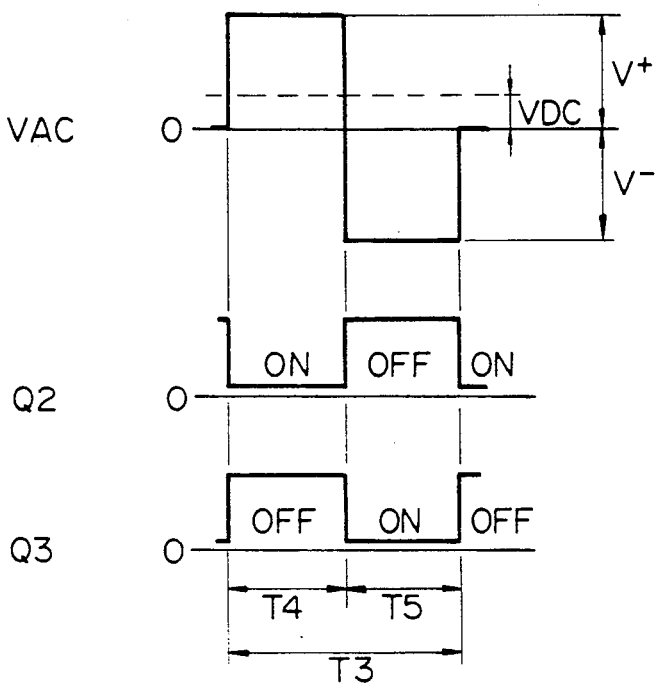
FIG. 13 is a timing chart representative of various signals appearing in the circuitry of FIG. 12.
Figure 14:
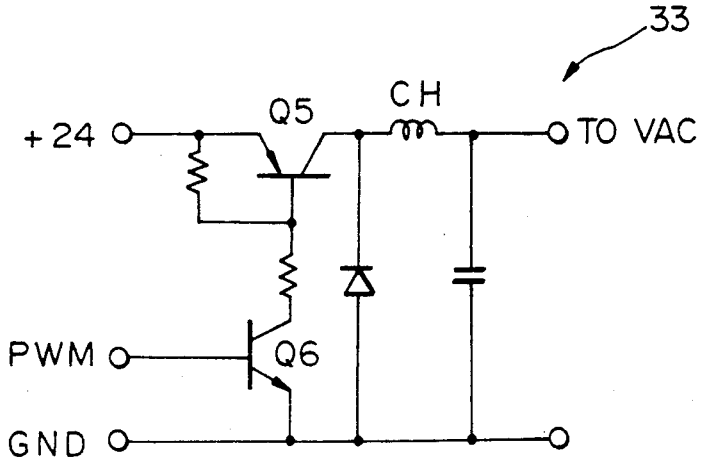
FIG. 14 is a circuit diagram showing an AC drive circuit.

The PT transformer 26, D transformer 27 and PC transformer 28 each outputs DC-biased AC power (AC 500 Hz, 5500 V rms) for corona discharge and has a circuit for stabilizing the output current thereof. Since the transformers 26, 27 and 28 are also identical in construction, only one of them will be described with reference to FIG. 12. In FIG. 12, the CPU 30 stabilizes the output of the transformer. As shown in FIG. 13, transistors Q2 and Q3 are turned on and off alternately with each other by a pulse signal fed from the oscillation circuit 36 which is shared by all of the transformers. As a result, an AC voltage VAC having a rectangular waveform is induced on the secondary side of a high-tension transformer HVT2. The rectangular waveform has the same durations T4 and T5 as to the positive and negative polarity and the same peaks V+ and V−. The transformers share the pulse signal from the oscillation circuit 36. Therefore, the waveforms of AC voltages induced on the secondary side of the respective transformers are synchronous. The AC voltage VAC is proportional to the DC voltage fed from the C drive circuit 33 to the transformer HVT2. As shown in FIG. 14, the AC drive circuit 33 is implemented as a chopper type DC/DC converter. The output of the AC drive circuit 33 corresponds to the duty of the PWM signal which is fed from the PWM timer 32 to the base of transistor Q6. The PWM signal has a period of about 20 kHz. It follows that the AC component of high-tension output is adjustable on the basis of the duty of the PWM signal, as desired.

Regarding the DC component, the output voltage of a high-tension transformer HVT3 is applied between the AC high-tension transformer HVT2 and ground. Hence, a voltage produced by applying a DC bias to an AC component VDC as indicated by a dashed line in FIG. 13 is fed to the load, i.e. between VH and ground. To generate this DC voltage, the PWM signal (0.05 msec) from the PWM timer 34 is amplified by the DC drive circuit 35 and then applied to the base of a transistor Q4 to switch it, and the resultant high voltage induced on the secondary side of the transformer HVT3 is rectified. Hence, the DC component of the high-tension output can be adjusted on the basis of the duty of the PWM signal from the PWM timer 34, as desired.

Figure 15:
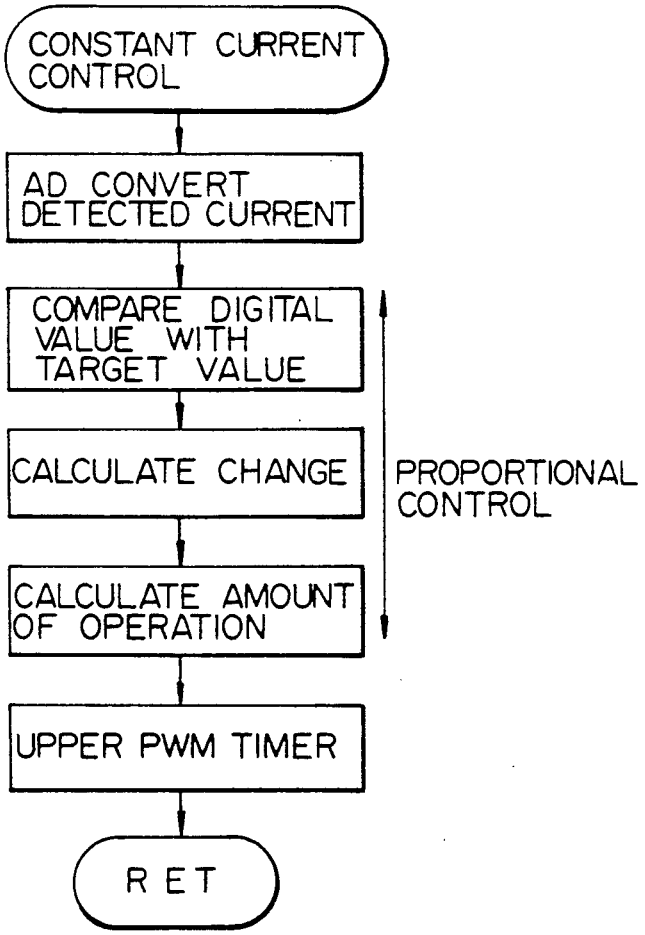
FIGS. 15, 16, 19A, 19B, 20A, 20B, 22, 23 and 24 are flowcharts each showing a particular sequence of processing steps.
Figure 16:
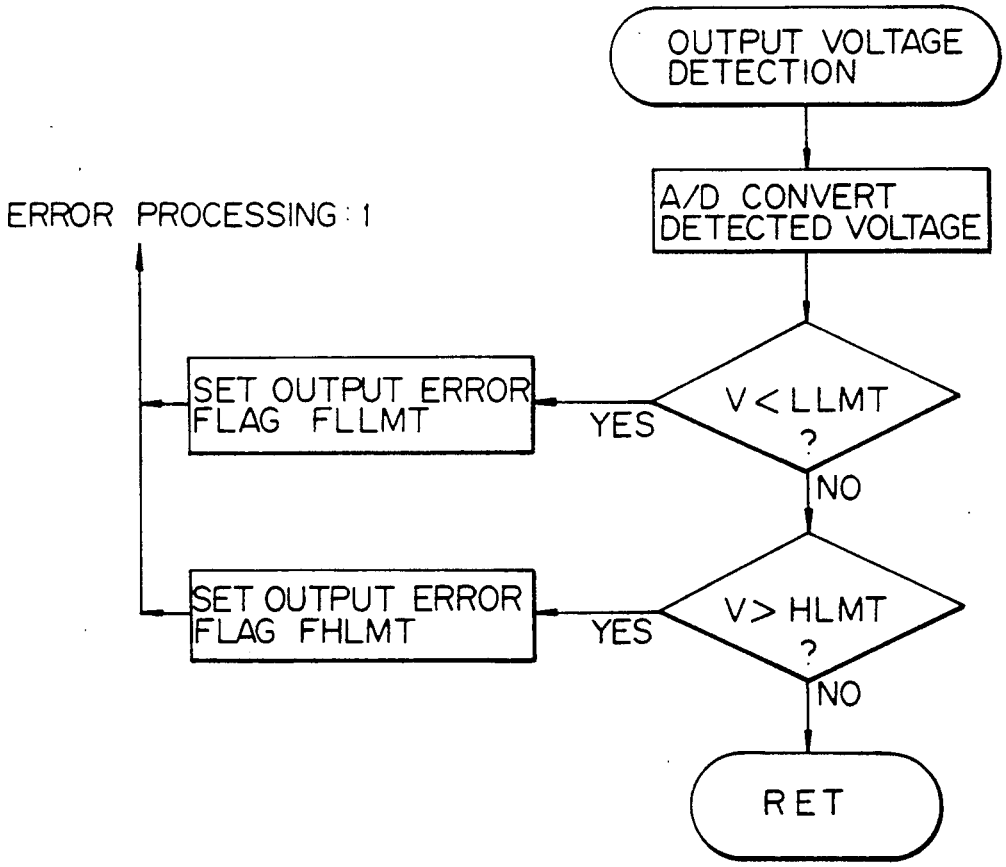

The control over the outputs of the transformers 26, 27 and 28 is as follows. While the overall output control is executed according to "OUTPUT DETECTION SCAN PROCESSING" shown in FIG. 19, the individual output controls will be described in detail. The output voltage and current are detected by the output detecting circuit 14 as low voltages. The voltage selected by the output detecting and selecting circuit 37 is applied to an input terminal of the CPU 30 adapted for A/D conversion. FIG. 15 shows a specific procedure which is executed at a predetermined period (e.g. 14 msec) for processing the detected voltage. As shown, the detected voltage fed to the CPU 30 is transformed into digital data. A difference between the digital data and a predetermined target value (hereinafter referred to as error data) is multiplied by a proportional constant, and the product is added to the value (amount of operation) existing in the PWM timer. The sum is written to the PWM timer as a new set value. The output voltage is detected at a longer period (e.g. 100 msec) than the output current and processed according to the flow shown in FIG. 16. In FIG. 16, the condition of the load is detected on the basis of whether or not the output voltage lies in a reference range, and processing matching the detected condition is executed. Specifically, in FIG. 16, the detected output voltage is converted into digital data, and whether or not the converted voltage V lies in a predetermined reference range is determined. If the voltage V is higher a reference value HLMT or lower than a reference value LLMT, it is likely that a serious error has occurred in the load. Then, an output error flag FHLMT or FLLMT is set, and the processing under way is interrupted and replaced with interrupt processing "OUTPUT ERROR: 1".

Figure 19A:
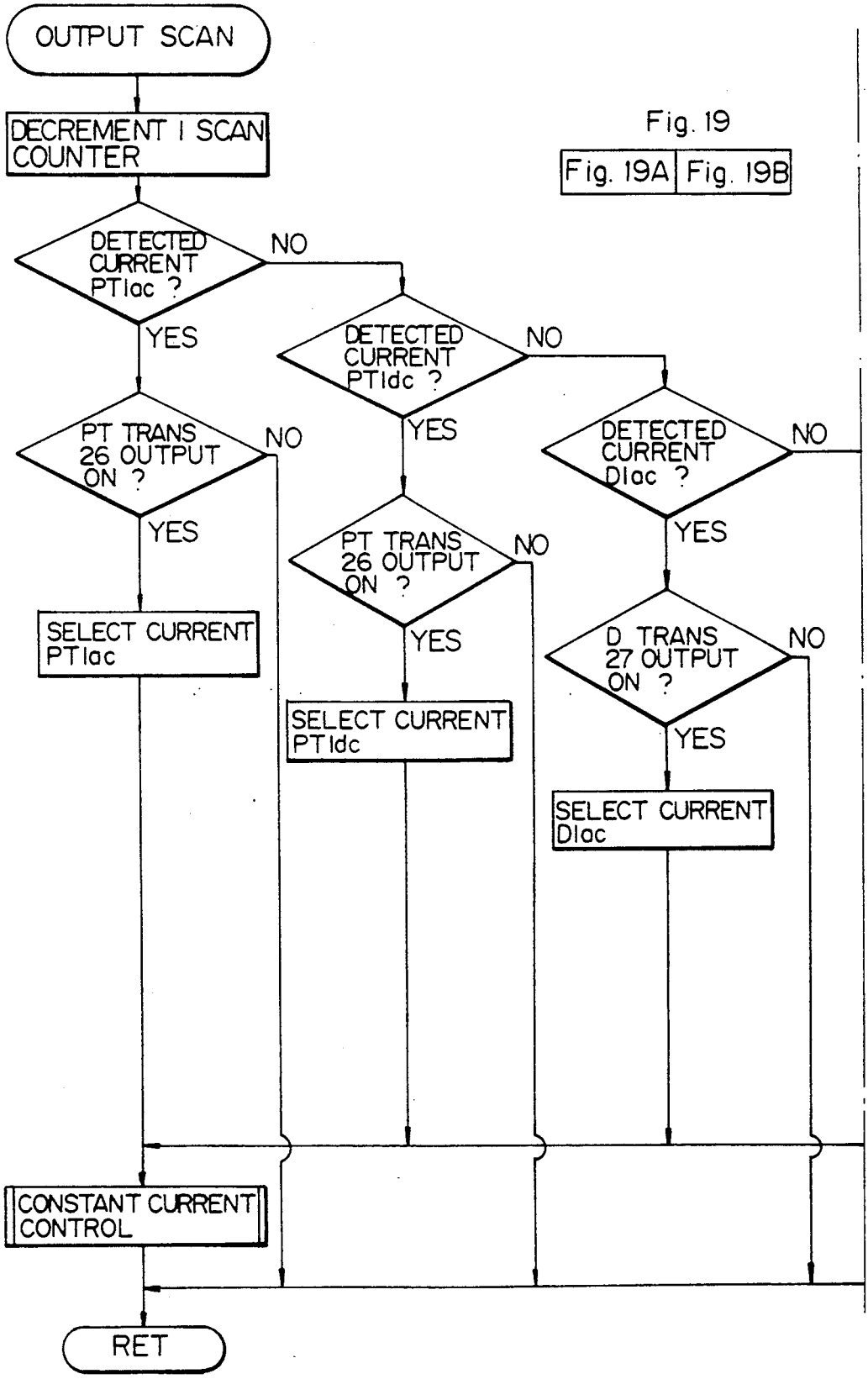
Figure 19B:
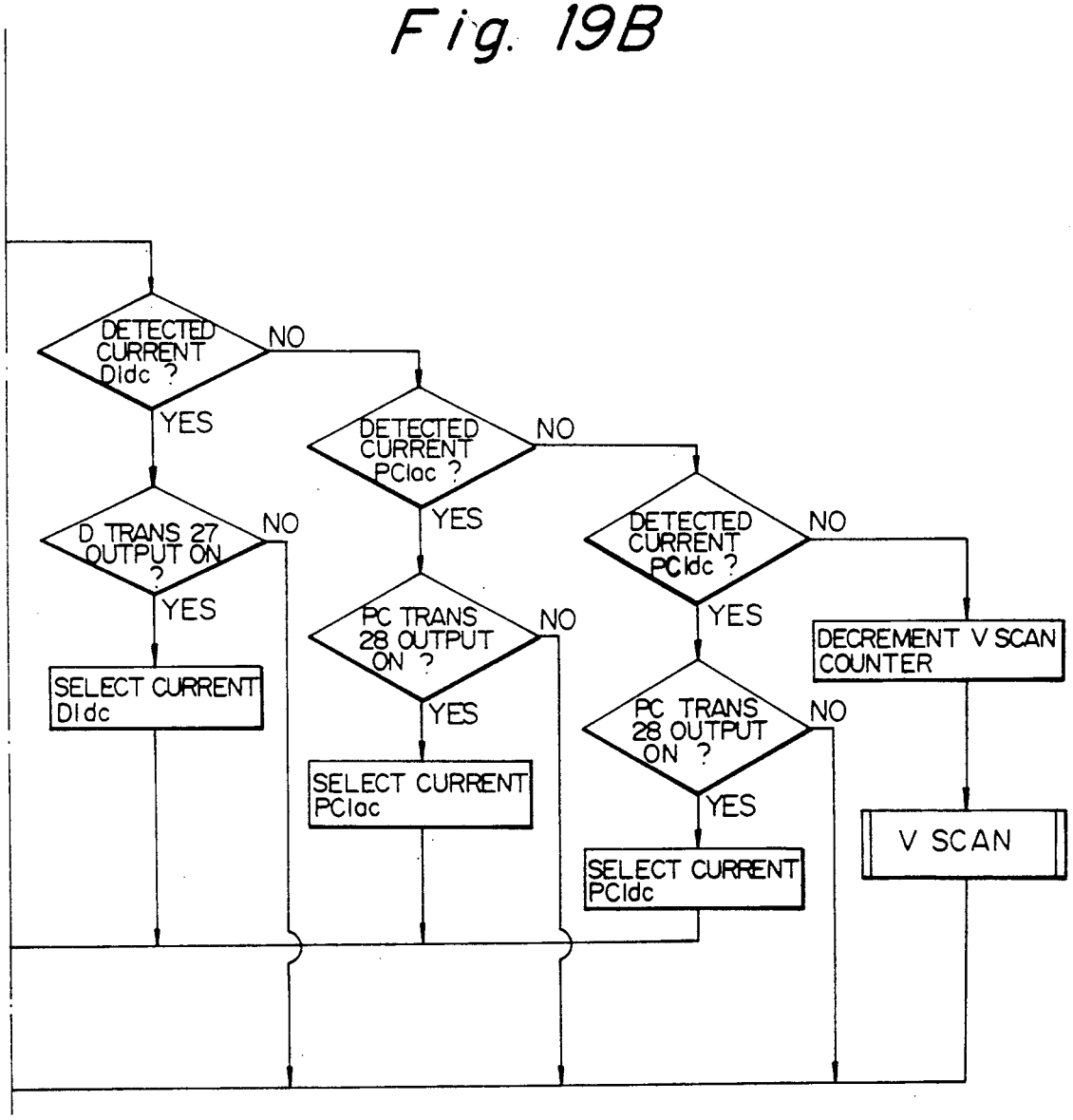

A procedure for detecting the outputs of the transformers will be described. Since the CPU 30 controls the outputs of the transformers collectively, the detection signals are processed by being scanned in a predetermined sequence. Detection signal Nos. 1 to 6 shown in FIG. 17 are detected at a period of 14 msec while detection signal Nos. 1 to 6 showin in FIG. 18 are detected at a period of 84 msec. FIG. 19 shows a specific sequence of steps for ececuting such processing and effected by an FB interrupt which occurs in the CPU every 2 msec. In this processing, two counters are implemened by a program. One counter or I scan counter counts every time this subroutine is executed (period of 2 msec) while the other counter or V scan counter counts every time the I scan counter counts up (14 msec). It is to be noted that the counts of the two counters are associated with the detection signals shown in FIGS. 17 and 18.

Figure 20A:
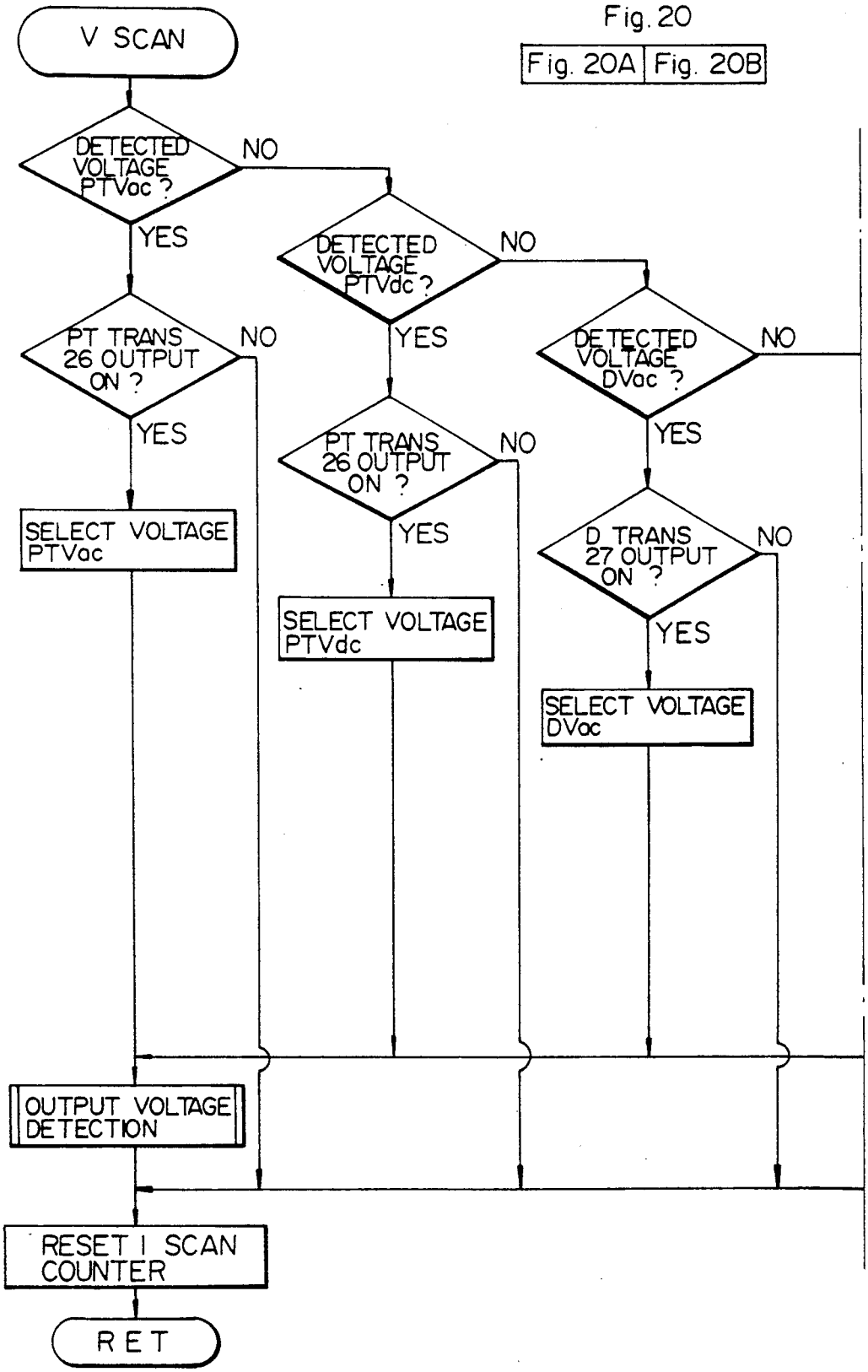
Figure 20B:
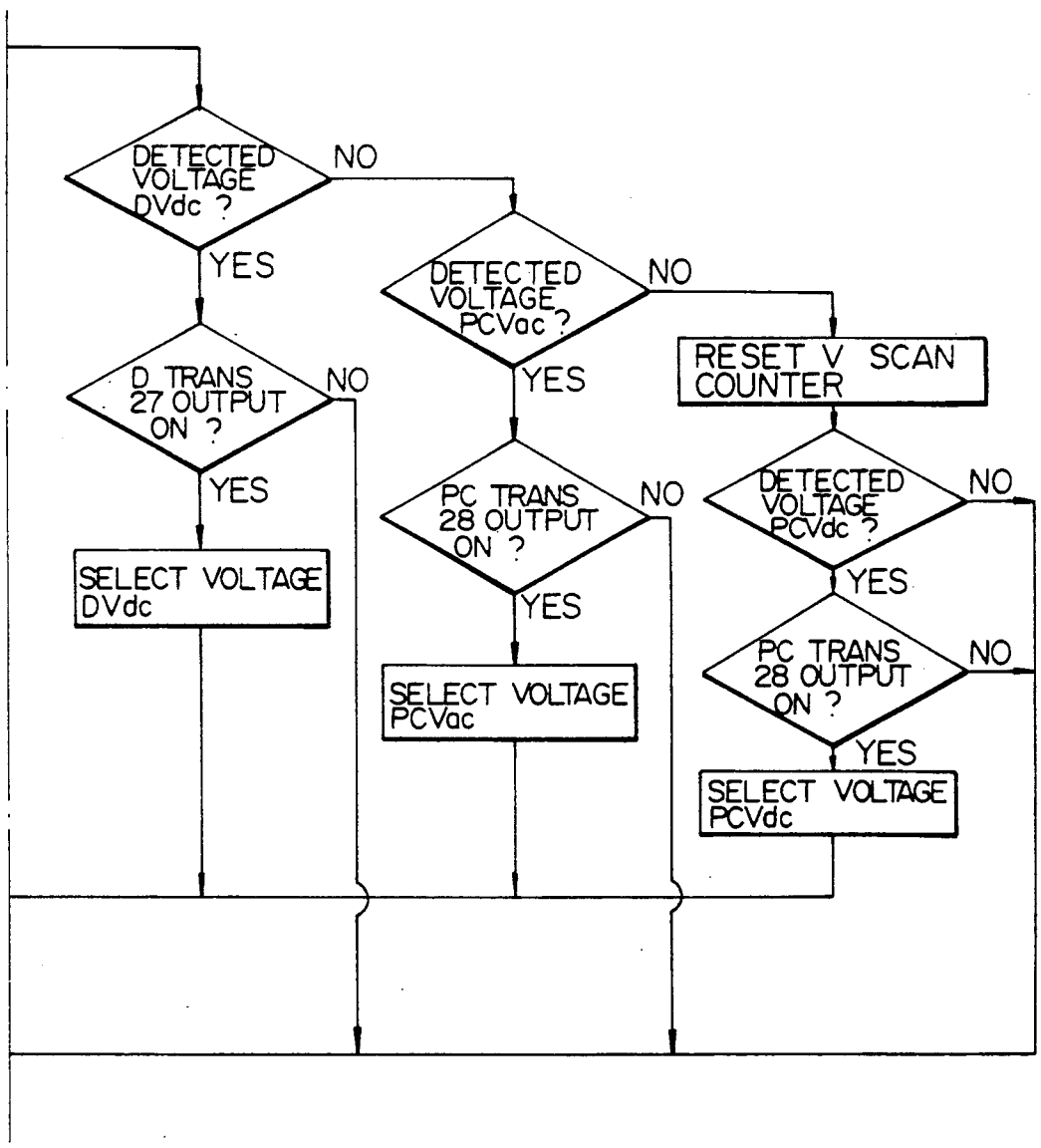

Referring to FIGS. 19 and 20, in response to an FB interrupt, the I scan counter is decremented and the corresponding detection value is selected. First, when the AC output current PTIac of the PT transformer 26 is detected whether or not the output of the PT transformer 26 ON (trigger ON) is determined and, if it is OFF, this processing is ended. If it is ON, the output detection signal PTIac is fed to the A/D converter of the CPU 30, and this processing is ended after a subroutine "CONSTANT CURRENT CONTROL" shown in FIG. 15. In response to the next FB interrupt, the current PTIdc is detected. Thereafter, currents DIac, DIdc, PCIac and PCIdc are sequentially detected in this order in response to successive FB ineterrupts. When a further FB interrupt occurs, the V scan counter is decremented and a subroutine shown in FIG. 20 is executed. In FIG. 20, the AC voltage PTVac of the PT transformer 26 is detected to execute a subroutine "OUTPUT VOLTAGE DETECTION". Subsequently, the I scan counter is reset and, in response to an FB interrupt, the current PTIac and successive currents are detected one after another. Hence, every time all the signals shown in FIG. 17 are detected, the signals shown in FIG. 18 are detected one after another.

Figure 21:
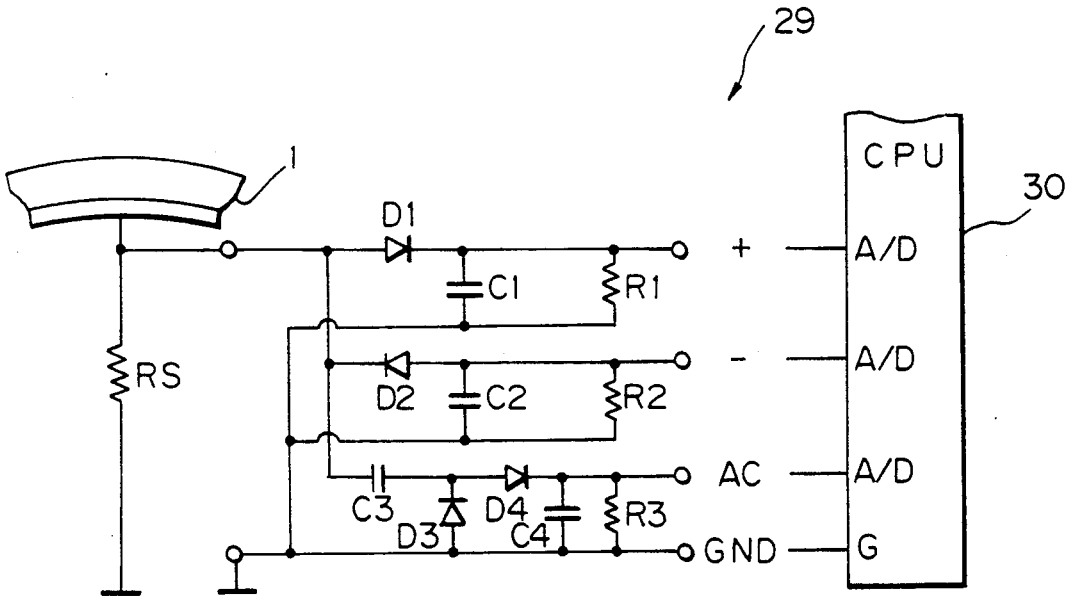
FIG. 21 is a circuit diagram showing an Id detecting circuit.

How the drum charge current Id flows through the drum 1 due to corona discharge will be described hereinafter. FIG. 21 shows a specific construction of the Id detecting circuit 29. As shows, the conductive base of the drum 1 is connected to ground via a resistor RS (e.g. 10kΩ) included in the Id detecting circuit 29. In this configuration, when a current Id flows through the drum 1 due to corona discharge, it flows through the resistor RS with the result that a voltage corresponding to the current Id is developed across the resistor RS. The voltage across the resistor RS is separated into three different components, and each of these components is converted into digital data by the CPU 30. Specifically, the positive component of the voltage is fed to a terminal A/D1 via a positive (+) component rectifying circuit constituted by a diode D1, a capacitor C1, and a resistor Rl. The negative component of the voltage is fed to a terminal A/D2 via a negative (−) component rectifying circuit, or polarity inversion circuit, constituted by a diode D2, a capacitor C2, a resistor R2. Further, the AC component of the voltage is aplied to a terminal A/D3 via an AC rectifying circuit made up of capacitors C3 and C4, diodes D3 and D4, and a resistor R3. The CPU 30, therefore, can measure the positive component, negative component and AC component of the voltage across the resistor RS at the same time. Further, the CPU 30 is capable of determining the size of the DC component included in the AC signal on the basis of the sum of the positive and negative components. In the drum charge current set mode, the three different signals applied to the A/D converter of the CPU 30 each is selected in association with the corona discharger of interest.

The drum charge current set mode is as follows. Briefly, the high-tension output appeared when the drum charge current Id is set at a predetermined value is subjected to constant current control. Specifically, in this particuloar mode, the corona dischargers each is caused to perform corona discharge independently of the others to change the value of the associated PWM timer or the target value of proportional control. When the value being detected by the Id detecting circuit 29 reaches a predetermined value (predetermined drum charge current), the output voltage of that moment is memorized and used as a target for constant current control. As shown in FIG. 9, the output current Io of each corona discharger is divided into a drum charge current Id and a casing current Ic. Nevertheless, the ratio of Io and Id usually depends solely on the contamination of the interior of the corona discharge due to paper dust, toner, etc. It follows that even when the actual drum charge current Id is not measured, the current Id can be controlled on the basis of the current Io if the target value of the current Io is corrected at a given period at which the change in the above ratio ascribable to contamination is allowable. This is why the above-stated setting is effected at the time when the power switch of the copier is turned on and ever time the image forming process is completed. In the drum charge current set mode, a particular setting method is applied to each of the power soruces 21, 23 and 25 and the transformers 26, 27 and 28. Specifically, for the power sources 21, 23 and 25, the set value of the PWM timer 31 is directly manipulated to set the drum charge current Id while, the transformers 26, 27 and 28, the target value of proportional control is manipulated.

Figure 22:
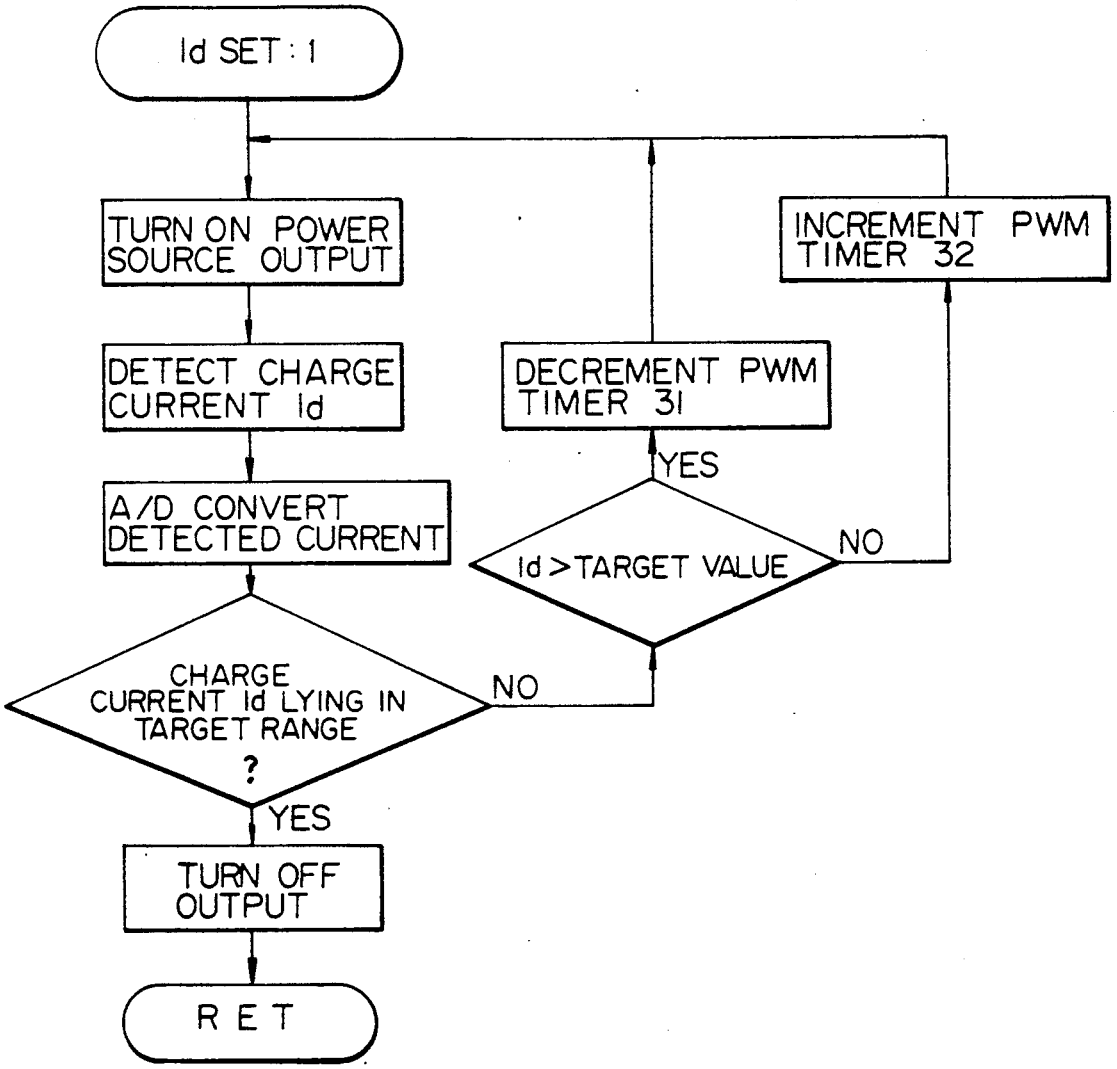

A specific procedure associated with each of the power sources 21, 23 and 25 is shown in FIG. 22. As shown, the output of the power soruce is turned on (trigger ON) first. At this instant, the output current changes in conformity to the duty of the PWM signal which is dependent on the current value set in the PWM timer. Initially, a predetermined reference value is set in the PWM timer. On the lapse of a 100 msec waiting time, the signal representative of the drum charge current Id detected by the Id detecting circuit 29 is converted into digital data. Then whether or not the digital data lies in a predetermined target range is determined. If the data answer of the decision is positive, the program ends. If otherwise, the PWM timer 32 is updated to set a new value produced by incrementing or decrementing the current set value of the timer 31. Such a sequence of steps is repeated until the detected data enters the target range.

Figure 23:
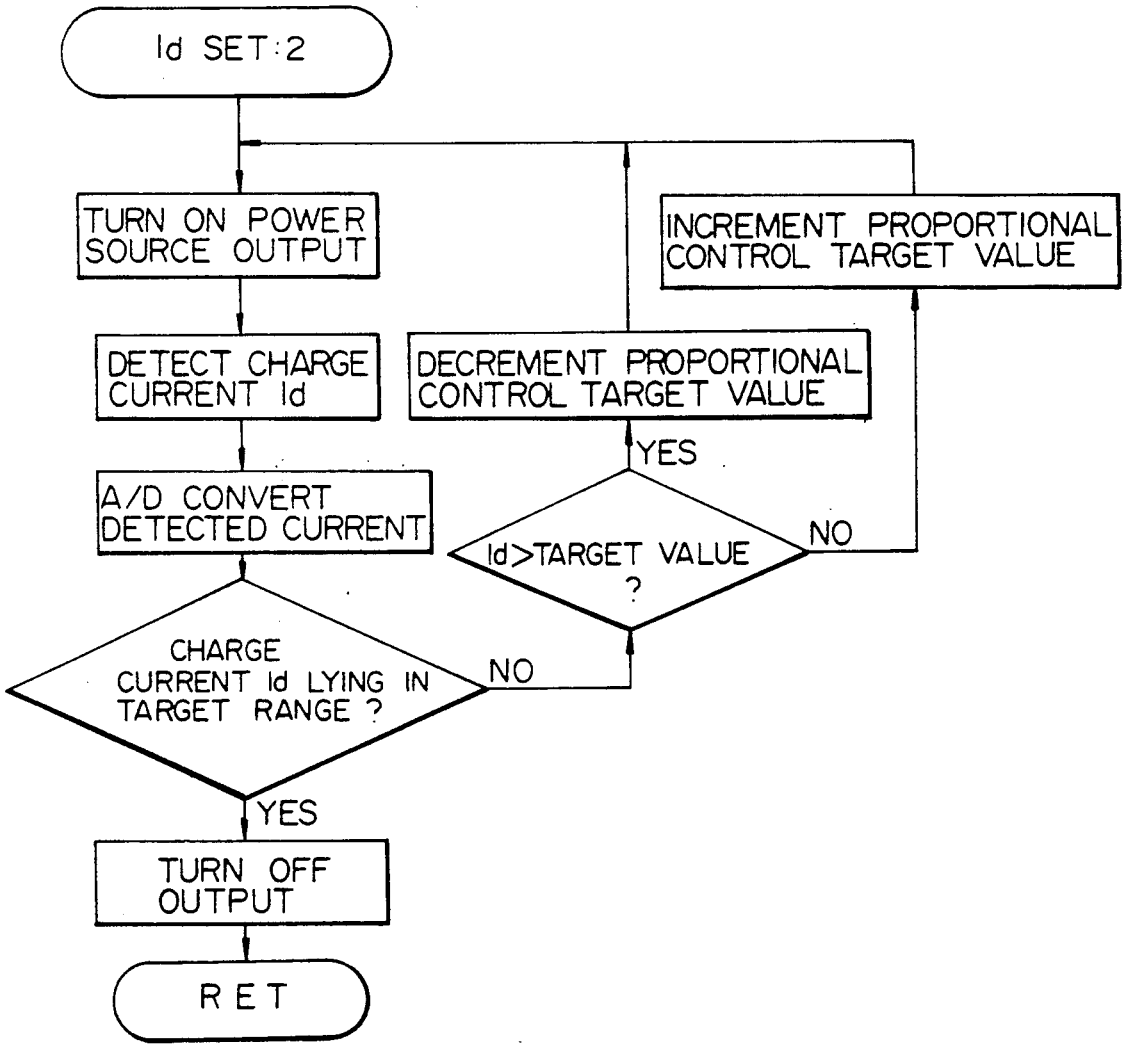

FIG. 23 shows a specific procedure associated with each of the transformers 26, 27 and 28. As shown, the "CONSTANT CURRENT CONTROL" subroutine, FIG. 15, is repeated several times (e.g. five times) to sufficiently raise the high-potential output. Then, the Id detection and A/D conversion as well as the decision on the detected data are effected. If the detected data does not lie in a target range, the target value for the "PROPORTIONAL CONTROL" subroutine is added to or subtracted from the current value. This is repeated until the detected data enters the target range of drum charge current Id.

Figure 24:
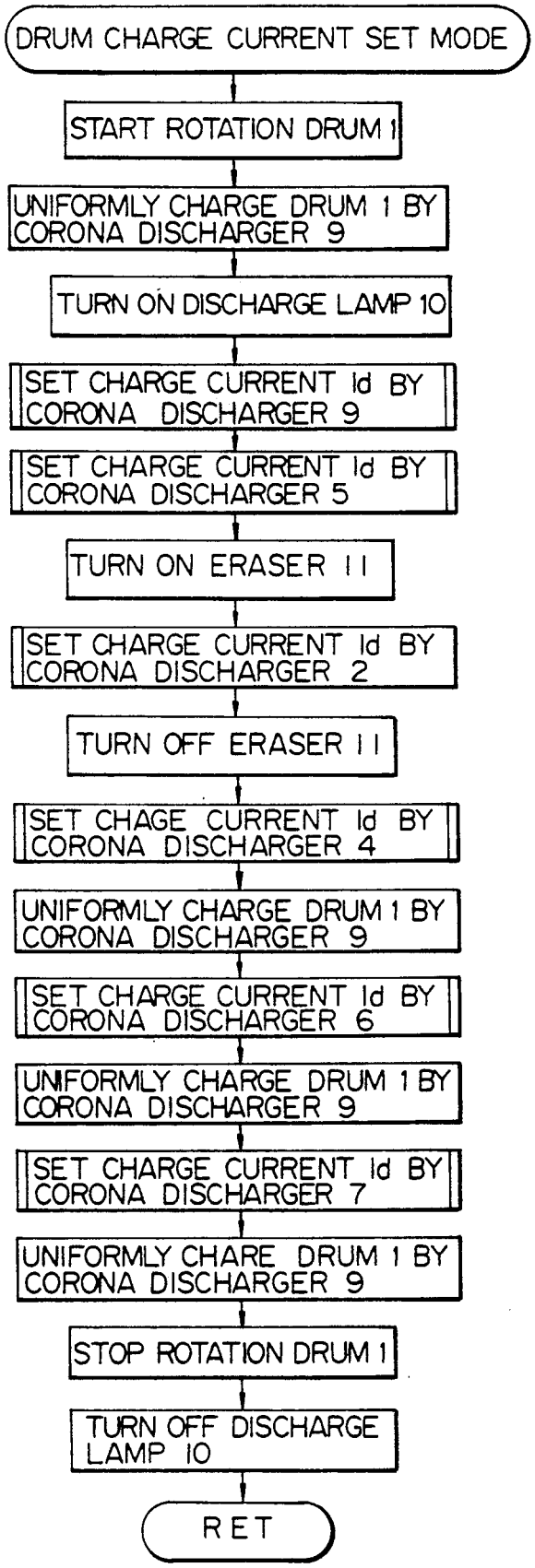

A reference will be made to FIG. 24 for describing the drum charge current set mode specifically. As shown, after the drum 1 has been rotated, the PQ corona discharger 9 is caused to discharge by an output current corresponding to the value which is set in the PWM timer 31 beforehand, whereby the drum 1 is uniformly charged over the entire surface thereof. Then, the discharge is stopped. Simultaneously with such a discharge, the discharge lamp 10 is turned on to discharge the drum 1 by light and is continuously turned on until this mode ends. Subsquentloy, a positive drum charge current Id due to the corona discharge of the PQ corona discharger is set according to a subroutine "Id SET: 1" shown in FIG. 22. Thereafter, drum charge currents Id due to the T corona discharger 5 and C corona discharger 2 are sequentially set by the same subroutine "Id SET: 1". During the setting operaiton associated with the C corona discharger 2, the eraser 11 is turned on to effect the discharge using light. This is followed by a procedure meant for the AC corona dischargers each effecting DC-biased AC corna discharge. In this case, an AC component and a DC component are sequentially set in this order. Specifically, after an AC component of the Pt corona discharger 4 has been set by a subroutine "Id SET: 2" shown in FIG. 23, a DC component is set by the same subroutine. The DC component is detected as a difference between the positive and negative polarities and is compared with a target value, as stated earlier. Subsequently, the entire periphery of the drum 1 is uniformly charged by the PQ corona discharger, and then the D corona discharger 6 and PC corona discharge 7 are sequentially set in this order. After the setting of the PC corona discharger, the drum 1 is brought to a stop and the discharge lamp is turned off.

In summary, in accordance with the present invention, a current which actually flows through an ordinary photoconductive element is detected and, therefore, can be adjusted without being replaced with a special jig. Moreover, since information associated with the inclination of a corona discharge relative to a photoconductive element is obtainable on the basis of the detected current, the inclination of the corona discharger can be readily adjusted without resorting to an ammeter or similar implement. The present invention, therefore, promotes easy and rapid maintenance work while noticeably reducing the down time of equipment.

Various modifications will become possible for those skilled in the art after receiving the teachings of the present disclosure without departing from the scope thereof.

What is claimed is:

1. An apparatus for positioning, relative to a photoconductive element of an image forming apparatus, a corona discharger located to face and extend along the axis of said photoconductive element and provided with a discharge electrode which causes a discharge to occur between said discharge eletrode and said photoconductive element in response to a high voltage fed from a power source and thereby causes a charge current to flow through said photoconductive element, said apparatus comprising:

current detecting means for detecting said charge current flowing through said photoconductive element;

position data generating means for generating position data associated with said corona discharger relative to said photoconductive element in response to said charge current detected by said current detecting means;

adjusting means for adjusting the relative position between said discharge electrode and said photoconductive element based on said position data; and charge current selecting means for causing said current detecting means to detect a charge current which flows through only a particular part of said photoconductive element, comprising masking means which, when removably mounted on said corona discharger, masks said photoconductive element except for said particular part.

2. An apparatus as claimed in claim 1, wherein said particular part of said photoconductive element comprises axially opposite end portions of said photoconductive element.

3. An apparatus as claimed in claim 2, wherein said position data generating means determines a difference between charge currents which flow through said axially opposite end portions of said photoconductive element and outputs said difference while relating said difference to an amount of adjustment of said adjusting means.

4. An apparatus as claimed in claim 3, further comprising display means for displaying said position data related to said amount of adjustment.

* * * * *